US008414217B2

(12) United States Patent
Rosan

(10) Patent No.: US 8,414,217 B2
(45) Date of Patent: Apr. 9, 2013

(54) HEAVY DUTY MODULAR FLOORING AND ROADWAY DEVICE

(75) Inventor: Arnon Rosan, New York, NY (US)

(73) Assignee: Signature Fencing and Flooring Systems, LLC, New York, NY (US)

( * ) Notice: Subject to any disclaimer, the term of this patent is extended or adjusted under 35 U.S.C. 154(b) by 0 days.

(21) Appl. No.: 13/090,364

(22) Filed: Apr. 20, 2011

(65) Prior Publication Data

US 2012/0266549 A1 Oct. 25, 2012

(51) Int. Cl.
*E01C 5/00* (2006.01)

(52) U.S. Cl.
USPC ..... 404/35; 404/40; 404/41

(58) Field of Classification Search ..... 404/35, 404/36, 40, 41
See application file for complete search history.

(56) References Cited

U.S. PATENT DOCUMENTS

| | | | | |
|---|---|---|---|---|
| 3,397,496 | A | 8/1968 | Sohns | |
| 3,964,221 | A * | 6/1976 | Berquist | 52/177 |
| 4,629,358 | A * | 12/1986 | Springston et al. | 404/35 |
| 4,840,825 | A * | 6/1989 | Aristodimou | 428/77 |
| 5,653,551 | A | 8/1997 | Seaux | |
| 6,511,257 | B1 | 1/2003 | Seaux et al. | |
| 6,649,110 | B1 | 11/2003 | Seaux et al. | |
| 6,684,582 | B2 | 2/2004 | Peart et al. | |
| 6,685,388 | B2 * | 2/2004 | Webster et al. | 404/35 |
| 6,695,527 | B2 | 2/2004 | Seaux et al. | |
| 6,909,373 | B2 | 6/2005 | Power et al. | |
| 7,303,800 | B2 * | 12/2007 | Rogers | 428/44 |
| 7,413,374 | B2 * | 8/2008 | Rogers et al. | 404/35 |
| 7,914,228 | B2 * | 3/2011 | Rapaz | 404/34 |

* cited by examiner

*Primary Examiner* — Gary S Hartmann
(74) *Attorney, Agent, or Firm* — Metz Lewis Brodman Must O'Keefe LLC; Barry I. Friedman

(57) ABSTRACT

A modular flooring system is disclosed which is designed to support heavy loads while providing stability and ground protection. The invention contemplates a modular mat having an integral main body with offset mounting and assembly flanges and a lattice interior. The mat is constructed from a unitary piece of high strength plastic. Each flange edge contains an outward radiused edge, while each non-flange edge contains an inward radiused edge. Each flange engages with a corresponding flange on an adjacent tile, allowing the outward radiused and inward radiused edges to properly mate. One or more metal cam locks located along the upper flange edges are secured into corresponding cam receptacles located along the lower flange edge. The mats may utilize optional top covers to prevent water and debris from entering the mats. The modular flooring system provides increased strength and stability and protection of the subsurface in heavy industrial applications.

20 Claims, 3 Drawing Sheets

HEAVY DUTY MODULAR FLOORING AND ROADWAY DEVICE

BACKGROUND OF THE INVENTION

1. Field of the Invention

The invention relates to a modular flooring and roadway system. More particularly, the invention relates to the use of modular floor mats which provide increased strength, stability and protection of the subsurface in heavy industrial applications.

2. Description of the Prior Art

Heavy duty modular flooring systems of various designs have been utilized for a significant period of time to provide a temporary and rigid surface in remote or inaccessible areas. More particularly, such systems are primarily utilized in settings where a firm and stable surface is temporarily needed, such as industrial or construction areas. With respect to industrial or construction areas, temporary flooring may be utilized to provide walkways, driveways, parking areas or other rigid surfaces for the transport of materials, vehicles, storage or mounting of equipment. The modular nature of such flooring is utilized to adapt the flooring to the particular topographic or geographic needs of the particular site and to also allow for the efficient storage and transport of the modular flooring. In addition, the use of relatively small modular floor mats permits repairs and disposal of broken floor sections with relative ease.

In operation, the selection of the particular floor mat and its characteristics are primarily based upon the amount of load expected to be exerted on the modular flooring system, as well as the relative support characteristics of the underlying substrate be it concrete, artificial turf, grass, dirt, or the like. Heavy construction applications require mats with higher strength and resistance to cracking and breaking.

Once the particular floor tile is selected, a number of modular tiles typically having some type of interlock mechanism are applied to the surface and are generally laid in a sequential pattern, permitting the selective interlock of the various tiles and the placement of those tiles in a preplanned topographic design intended to permit the movement of materials, people, vehicles or the storage of the same in appropriate locations.

Traditional materials for the construction of temporary roadways or construction support surfaces included wood boards or planks. This method generally requires the use of a large number of boards attached with nails, screws, or bolts in a side-by-side manner. Positioning and removal of the planks is time consuming and labor intensive and may require cranes and other equipment. The wooden boards are also susceptible to cracking and warping due to the excessively heavy loads encountered in construction sites and environmental factors such as rain. Water may pass through the seams or spaces between the boards onto the surface below producing a muddy condition. The use of heavy equipment on mud causes damage to the subsurface as well as the equipment in use and can make a work area unsafe or unsanitary.

Other types of modular floor mats are typically constructed of plastic or other polymeric materials which permit relatively high-strength sections having relatively low weight, providing ease of storage and portability. One particular shortcoming of plastic and polymeric materials is the coefficient of thermal expansion, which is relatively high in practice. Changes in temperature of the underlying substrate material, sunlight, as well as the ambient air proximate to the modular floor system cause relatively significant changes in dimensionality of the floor tiles. While the dimensional changes in each individual tile are relatively small, over a large area with hundreds, perhaps thousands, of interlocked mats, the cumulative expansion or contraction of the entire flooring system causes significant problems with respect to maintenance of the floor, as well as the safety of the users. In practice, this expansion of the modular flooring system causes buckling, shifting and cracking of the floor tiles, potentially causing dangerous conditions which could cause vehicles to be diverted from their intended course over the surface of the modular floor. Sudden or large changes in temperature combined with large compressive forces from heavy machinery may cause cracking and separation of the tile itself in areas where separate sections of the tile are fused or joined.

In addition, the plastic and polymeric mat system may cause damage to the surface on which it is assembled, similar to that described above with reference to wooden mat systems. For instance, even short term placement of the panels on grass or turf may harm the surface due to decreased exposure to sunlight and ventilation. Human or industrial use of the temporary flooring may also expose the underlying surface to various substances which may be harmful, for instance gas or oil that leaks from heavy equipment.

Because of the high costs associated with industrial operations in remote areas, installation and removal of heavy duty modular floor mats must be accomplished quickly. As a result, the current ground protective surfaces are constructed to comprise a number of units that are connected together to provide a large area covering of desired size. The connectors are generally constructed of the same plastic, metal, or other polymeric material as is utilized with the panels and are connected directly to the panel itself. As a result, damage to one of the connector points on the panel necessitates the replacement of the entire panel, thus increasing the cost and time required for assembling the flooring system.

U.S. Pat. No. 5,653,551 to Seaux describes a mat system comprised of two mirror-image components affixed together in an offset configuration to form a single mat. The mats are restrained from horizontal movement by frictional contact with the underlying terrain and mechanical contact with adjoining mats such that additional restraining means are not used.

U.S. Pat. No. 6,649,110, to Seaux, teaches a mold apparatus and a method of manufacturing floor mats comprising roughly continuous outer surfaces and an internal cellular structure.

U.S. Pat. Nos. 6,695,527 and 6,511,257 to Seaux et al. teach a reusable mat system for the construction of load bearing surfaces such as roadways. The mats are constructed of two minor-image half pieces which are joined together to form a complete single mat. Each half-piece comprises an outer skin and an inner cellular structure. The mirrored mats are provided with affixation mechanisms in the form of protruding bosses which are inserted into corresponding receptacles in the mirror mat. The mats are then secured together to form a unitary mat for interlocking with other, similar mats. Each assembled double mat is then interlocked with its neighboring mats through the use of reversible dowel pins. These pins are press fit into the interlocked mats.

There remains a need, therefore, in the art of modular flooring, for a modular flooring system containing mats which maintain high strength and durability for heavy loads along with consistent alignment and location of sections for the entirety of the modular floor over its length. There is a need for floor panels molded from a single piece of material and which contain no parts that will crack, break, shear or detach when subjected to heavy loads. There is a need for floor panels with high strength connectors which may be easily and economically engaged and disengaged, as well as replaced when damaged. There is a need for floor panels that are more easily aligned and connectable in the field.

SUMMARY OF THE INVENTION

A modular flooring system is disclosed which is designed to support heavy loads while providing stability and ground protection. The system comprises mats constructed from a single unitary piece of material and contains an integrated connection system which is self-aligning and provides strength and durability. The system also provides increased protection of the covered ground surface.

In one embodiment, the mat comprises a main body with a lattice interior. The mat is constructed from a unitary piece of high strength plastic, optionally reinforced with additives for added strength, flex and impact characteristics. The lack of distinct parts allows the mat to withstand greater load burdens with the decreased possibility of separately affixed sections cracking, breaking or otherwise becoming dislodged from the mat. This unitary design eliminates a shear point that exists in mats constructed from multiple mirror image sections that are then bolted together. The internal lattice construction provides increased strength and stability while decreasing the weight of the mat. By having an internal lattice system that spans essentially the full height of the panel, without a break or other stop, stiffness and strength is increased exponentially.

The mats of the present invention provide for increased protection of the covered subsurface. Specifically, the offset configuration of the main body provides for extended flanges on two sides of the device. Typically, each flange edge contains an outward radiused edge, while each non-flange edge contains an inward radiused edge. It is to be specifically noted that variations in the edge geometries and alignments are contemplated for various applications and the device is not limited thereby. The flange of a first mat engages with a corresponding flange on an adjacent mat, allowing the outward radiused and inward radiused edges to properly mate. This interlocking arrangement allows for self alignment of the floor mats and greater ease of installation. In addition, the mats overlap at an angle other than 90 degrees, providing greater strength at the point where adjacent mats meet. Furthermore, said radius provides additional strength to the protruding flange, which is most prone to breakage, by eliminating a sharp shear point at the point where the flange meets the main body of the panel. The overlapping mats help to prevent the leakage of unwanted liquids onto the ground below. One or more metal cam locks are located along the upper flange edges. These cam locks are secured into corresponding cam receptacles located along the lower flange edge. The mats may utilize optional top covers on the main body and flanges to prevent water and debris from entering the interior structure. Such top covers may be nested and set into an interior rim that provides added strength and protection against shearing off of the top covers. Such rim protects said top cover from damage or displacement. Furthermore, each main panel may include a recessed channel on the inside of such rim that may accommodate a rubber or other type of gasket that when inserted under the top cover assists in sealing of the mats' interior from water and other debris.

DESCRIPTION OF THE PREFERRED EMBODIMENTS

Figure 1:
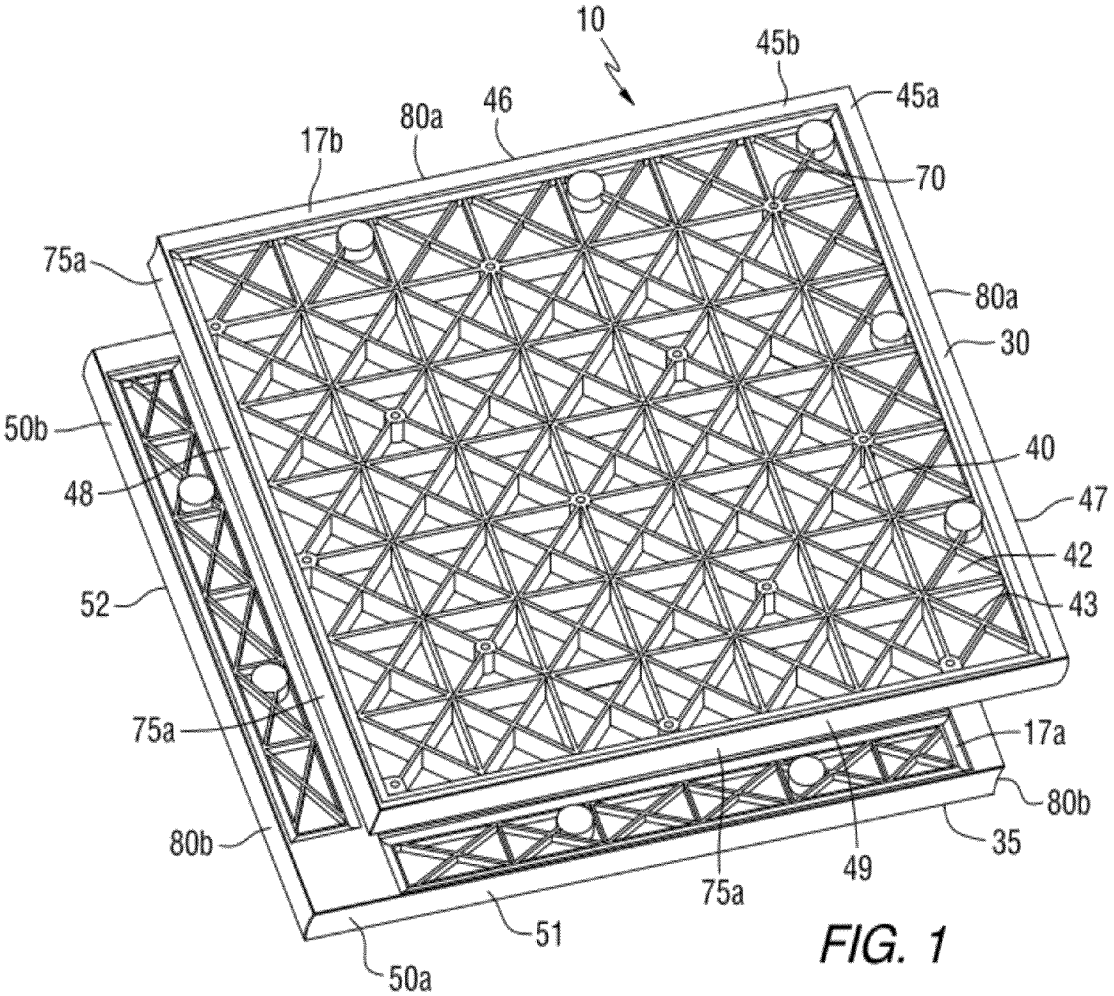
FIG. 1 is a top isometric view of a modular floor mat in accordance with the present invention.
Figure 2:
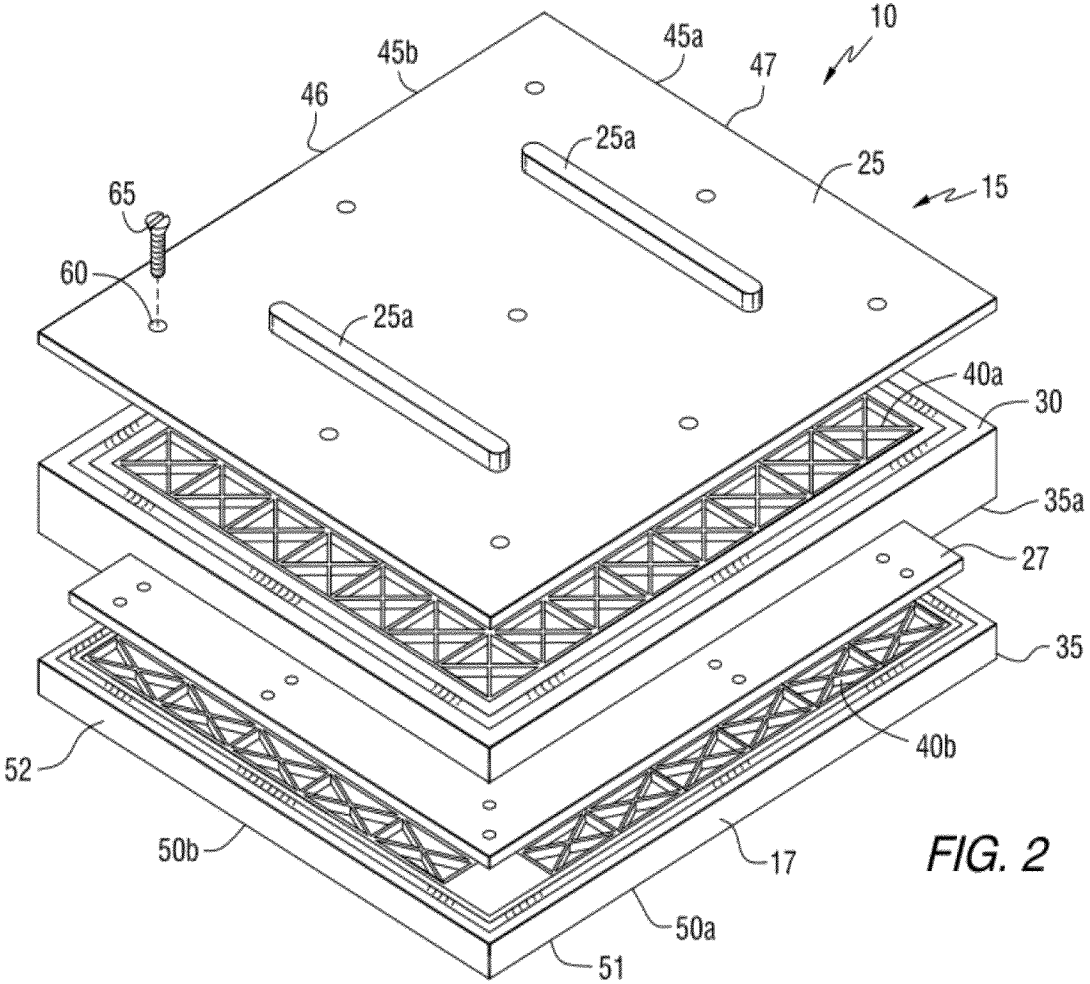
FIG. 2 is an exploded top isometric view of a modular floor mat of the present invention.

Referring to FIG. 1, an individual floor mat 10 of the invention is comprised of main body component 15 and flange components 17*a*, 17*b*. Main body 15 and flanges 17*a*, 17*b* and are constructed as one unit from a single piece of material. Main body 15 and flanges 17*a*, 17*b* have a generally upper planar surface 30 and main body 15 and flanges 17*a*, 17*b* have a generally planar lower surface 35 (not shown). Flanges 17*a* and 17*b* are positioned so that they are mutually offset relative to each other, thereby resulting in overhang or flange surfaces 45*a*, 45*b* on two adjacent peripheral edges 46 and 47 and flange surfaces 50*a*, 50*b* on two adjacent peripheral edges 51 and 52. Each of the modular floor mats 10, with the exception of the interchangeable aluminum cam 20 locks and top covers 25*a* and 25*b*, as hereinafter described in greater detail, is preferably formed as a one-piece unit from a single piece of material (FIG. 2). Modular floor mats 10 are provided for use as part of an interlocking matrix, discussed in detail below, which extends in two dimensions in accordance with a preset topographic plan (not shown). The topographic plan is typically directed towards the conveyance or support of equipment, vehicles, personnel and the like and is adapted to conform to the topographic or geographic features of the substrate surface, such as grass, dirt, artificial turf or the like. When connected in a matrix, the mats 10 of the present invention provide distribution of heavy weights over a larger surface area, thus allowing heavy equipment to traverse varying ground conditions.

FIGS. 1 and 2 illustrate a modular floor mat 10 of a generally of square configuration. However, any suitable shape, including rectangular or hexagonal, is suitable provided that the sides and ends of the mats are adapted for contiguous alignment with adjacent mats. Each modular floor mat 10 provides, for example, a usable surface of 6.5 ft.×13 ft. and is, for example, 4¼ in thick, with a total size of 7.5 ft.×14 ft. Generally, a number of modular floor mats 10 would be used, for example, 50, 75, 100 or more mats. Such mats are essentially of the same size and shape to prove for contiguous coverage of the surface. Specialized end surfaces (not shown) may also be utilized to terminate the interlocked mat surface.

With respect to the use of the modular floor mats 10 of the present invention, the sides and ends of the mats, when installed as a heavy duty modular flooring system, are essentially in continuous contact with each other. Therefore, there are no significant gaps between the modular floor mats 10 to provide essentially complete coverage of the subsurface.

Modular floor mats 10 are typically constructed of a single piece of plastic material and are preferably polypropylene, polyethylene, polystyrene, acrylonitrile butadiene styrene, and polyvinylchloride. In a preferred embodiment, the modular floor mats 10 are constructed of high-density polyethylene (HDPE) post-industrial recycled plastic, optionally reinforced with adhesives for added strength, flex and impact characteristics. This material is resistant to a wide range of temperatures. The material is also extremely strong and able to bear large loads as are common in construction areas. The unitary construction of the mat provides for added strength and decreases the likelihood of cracking or breaking of separate mat components. The material composition of mats 10 may additionally include impact modifiers for added strength, UV resistant fillers to prevent degradation and delamination and anti-static additives. However, it should be understood that the modular floor mats 10 may be constructed of any suitable material having the strength and durability requirements necessary for their intended purpose. The top surface 30 and top cover 25 may comprise a flat configuration, but may also contain some texture or surface features to provide traction to the smooth surface, as discussed in more detail below.

In a preferred embodiment, the internal region of mat 10 comprises a lattice structure 40*a*, 40*b* which is dispersed within the central core area of main body 15 and flange 17. Lattice structure 40*a*, 40*b* is defined by a series of interconnected cells 42 and cell walls 43. This cellular structure adds strength and durability to mat 10 while reducing the weight of the mat. Lattice structure 40*a*, 40*b* extends across the entire interior area of main body 15 and flange 17. Such placement allows for equal weight distribution and minimizes surface area contact with the ground or floor beneath modular floor mat 10. Although lattice structure 40*a*, 40*b* is illustrated in a square or rectangular configuration, other shapes, such as a honeycomb, may be utilized. Lattice structure 40*a*, 40*b* is fully integrated into modular floor mat 10, i.e., it is integrally constructed or molded from the same strong HDPE material and is not a removable component.

Differences between the illustrated embodiments, as well as other embodiments not illustrated herein, but within the scope of knowledge of one skilled in the art, would include changes in dimensionality, including height, width and length, as well as surface features. One significant feature of modular floor mat 10 when assembled into a matrix is the desire to reduce any misalignment or unintentional three-dimensional surface changes in the top surface 30*a* of the floor mats. Any height misalignment or departure of the floor mat from uniform engagement with the substrate may result in an unsafe condition presented by improper interlocking of modular floor mats 10 or buckling of the entirety or portions of top surface 30*a* causing an uneven walking or vehicular traffic surface.

Referring to FIG. 2, main body 15 includes a main body cover 25 which is placed over top surface 30, thereby completely covering lattice structure 40*a*. Main body cover 25 defines a generally planar work surface on one side of top surface 30. Similarly, flange cover 27 covers the upper surface 55 of flange 17. The design of the covers 25, 27 is intended to provide a relatively flat surface while allowing for additional strength, rigidity, weight distribution and a closed environment for the cellular structure of the central core area. Covers 25, 27 prevent water and debris from entering the interior lattice structures 40*a*, 40*b* of mat 10. Such water and debris may prohibitively increase the weight and rate of deterioration of and damage to mat 10. In one embodiment, main body 25 has a plurality of traction elements 25*a* mounted thereon to allow for traction. Traction elements 25*a* improve the frictional characteristics of mat 10, improving traction for vehicles and other equipment. Traction elements 25*a* generally extend outward from the planar surface of main body cover 25 but may be of any orientation or dimension. Furthermore, combinations of raised and recessed elements may be applied. The size, shape and design of the traction elements 25*a* may vary depending on the intended use of heavy duty floor mat 10. Covers 25, 27 are typically constructed of the same material as described above for mat 10. A plurality of holes are positioned on covers 25, 27 and are placed in general alignment with screw receptacles 70 (FIG. 1) in the underlying lattice structures 40*a*, 40*b*. Hole 60 and screw receptacle 70 receive screw 65 (or any other fastener) to affix covers 25, 27 to mat 10. In accordance with the specific design features of each embodiment, the hole 60, screw 65 and screw receptacles 70 may be of any size or shape appropriate to support the weight and load requirements of the mat. Furthermore, the number and distribution of the holes 60 are determined by the physical conditions of the likely substrate, as well as the particular load requirements.

Large panel structures, such as those constructed for use in construction settings, are subjected to high amounts of lateral and torsional stress. To overcome this problem, rotating cam lock 20 is shown located in one corner of flange surface 45 as shown in FIG. 3. Cam lock 20 further comprises locking pin 22. Utilization of one or more cam locks 20 adds strength and prevents movement of modular floor mat 10 when subjected to heavy loads or fluctuation in temperature. By connecting mats 10 in multiple locations with cam locks 20, the assembled flooring system may withstand larger moving weights. In a preferred embodiment, a plurality of cam locks 20 are placed along the outermost adjacent offset edges of flange 45. The placement of cam locks 20 on flange 45 correspond with the placement of cam receptacles 85. Cam receptacle 85 further comprises locking pin receiver 87, which is adapted to receive and restrain locking pin 22. Cam receptacles 85 are placed along the outermost perpendicular edges of flange 17 and disposed geometrically in accordance with the corresponding location of cam lock 20 on an adjacent mat 10. The purpose of cam receptacle 85 is to receive and restrain locking pin 22 from an adjoining mat 10. A key or tool (not shown) is used to rotate the locking pin 22. Cam 20 is an offset cam which is reversible, thus allowing for the construction and disassembly of the modular flooring system. It will thus be appreciated that the sequential application of modular floor mats 10 will include the serial locking of adjacent floor mats in a matter to extend such mats in two dimensions. Prior art cam locks are generally constructed of plastic materials, for instance the same plastic used in the construction of the floor mat 10. In contrast, cam lock 20 and cam receptacle 85 may be constructed from a high grade metal, for example aluminum, which provides increased torsional strength and stability for heavy load applications. Metal cam locks are more resistant to damage that their plastic counterparts. Cam locks 20 and cam receptacles 85 are self contained modular units which may be removed from floor mat 10 if they become damaged. This prevents the need to replace the complete modular floor mat 10 if cam locks 20 or cam receptacles 85 become unusable, thus reducing the costs associated with present modular mat system.

Referring again to FIG. 3, at least one of main body 15 and flange 17 are provided with outward radiused edge 80*a* along adjacent offset edges 46, 47 of flange surface 45 or main body 15. The non-flange adjacent edges 48, 49 of flange 45 surface contain inward radiused edge 75*a*. Likewise, at least one of flange 17 or main body 15 are provided with outward radiused edge 80*b* along the adjacent offset edges 51, 52 of flange surface 50. In addition, the non-flange edges 53, 54 of flange surface 50 or main body 15 contain inward radiused edge 75*b*. As a result, the outward radiused edge 80*b* of flange surface 50 fits beneath and operatively engages the inward radiused edge 80*a* of flange surface 45 of an adjacent mat 10 in a direction that deviates substantially from the vertical direction. Specifically, the configuration and position of the inward radiused edge 75*a*, 75*b* and the outward radiused edge 80*a*, 80*b* of adjacent mats 10 prevents adjacent modular floor tiles from overlapping at a ninety-degree angle and increases strength. A substantially vertical or ninety-degree angle at the point of overlap causes shear stress and weakens the connection between the adjacent modular floor mats 10, which may result in cracking or breaking of the modular floor mats 10. This inward radiused edge/outward radiused edge configuration reduces this shear stress and strengthens the flange 45 and flange 50 connection between mats 10. The configuration and position of the flange surface 45 and flange surface 50 and the inward radiused edge/outward radiused edge provides continuous coverage of the subsurface and prevents unwanted liquids from reaching the surface. In addition, flange surface 45 fits snugly into flange surface 40 and is not readily removable, thus ensuring a conforming fit of adjacent mats 10 within the assembled floor.

In practice, the flooring system of the present invention is constructed by overlapping flange surfaces 45*a*, 45*b* of a first mat 10 with the flange surfaces 50*a*, 50*b* of a second mat (not shown in the Figures). The outward radiused edge 80*b* of flange surfaces 50*a*, 50*b* of the second mat fits beneath and operatively engages the inward radiused edge 80*a* of flange surfaces 45*a*, 45*b* of the first adjacent mat 10 in a direction that deviates substantially from the vertical direction. The inward radiused edge/outward radiused edge configuration forces the adjacent mats to align properly. This in turn forces the alignment of cam lock 20 with cam receptacle 85. Locking pin 22 is then inserted into locking pin receiver 87 and then rotated 45 degrees using a standard ¾ in. hex tool or other such device, such as a screwdriver. This configuration provides continuous coverage of the subsurface and prevents movement and shifting of mats 10. The resulting flooring matrix of is provided with added strength and durability because of the unitary construction of heavy duty mats 10, which reduces the probably of separate components cracking or breaking. Removal of locking pin 22 is accomplished by tuning locking pin 22 with an appropriate tool. For removal, all locking pins 22 are disengaged and mat 10 is disconnected from the adjacent mat. Because all mats 10 are identical in construction, mats 10 may be connected in all directions, allowing for the construction of any sized work compound, equipment pad, access road or other contiguous surface.

Figure 3A:
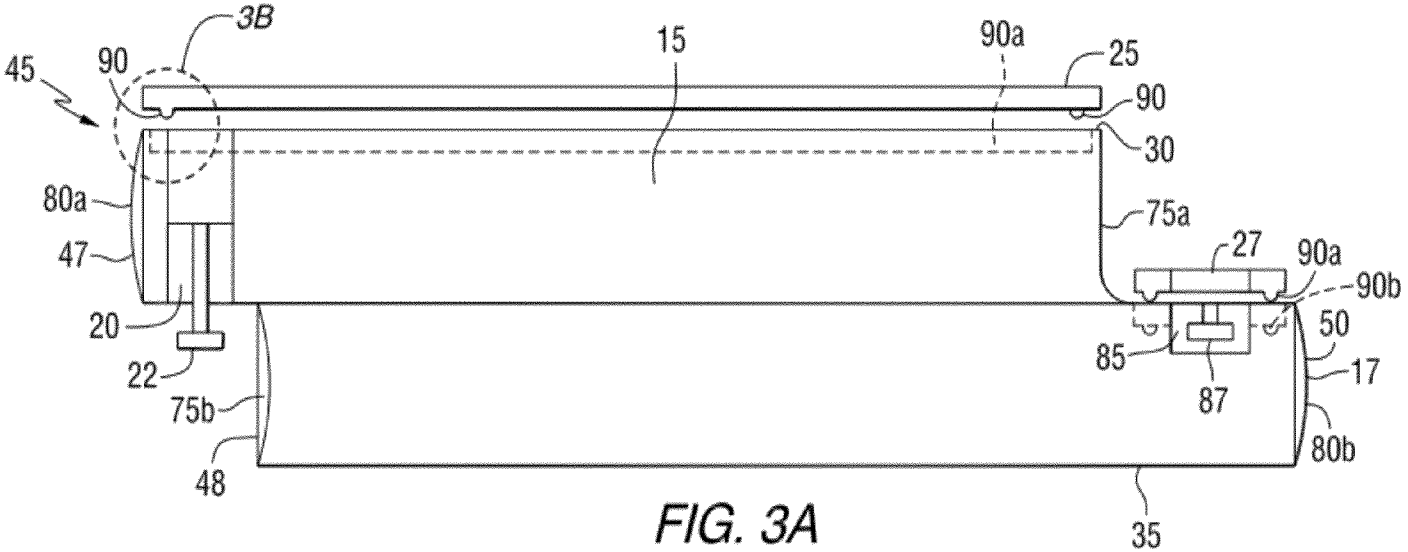
FIG. 3A is an exploded side view of a floor mat of the resent invention.
Figure 3B:
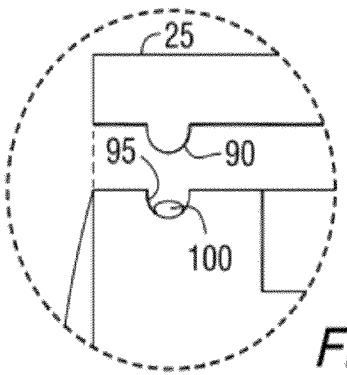
FIG. 3B is a exploded side view of a detailed section of FIG. 3.

Referring again to FIG. 3, covers 25, 27 are optionally provided with downward protrusion 90 which is placed along the entirety of the outer edge in a first embodiment of the cover and receiver illustrated in FIGS. 3A and 3B. Correspondingly, cavity 95 is placed on the upper surface 30 of main body mat 15 or flange 17 and corresponds with the placement of protrusion 90. Cavity 95 is adapted to receive downward protrusion 90. In addition, cavity 95 is adapted to receive seal 100 which resides entirely within cavity 95. Seal 100 is constructed from an elastomeric material, for example rubber. Covers 25, 27 are secured onto upper surface 30 by inserting protrusion 90 into cavity 95. Seal 100 prevents dirt, water and other debris from entering the interior lattice structure 40*a* of mat 10. Additionally, recesses 90*a*, 90*b* may optionally be provided in a second embodiment of the cover and receiver more particularly illustrated in FIG. 3A. Recesses 90*a*, 90*b* are shown in chain line to form a receiver area sized and shaped to receive covers 25, 27 which will then mount flush, or be nested with the outer surface of modular floor mats 10. The use of protrusion 90 and/or cavity 95 may be eliminated in this embodiment. A seal (not shown) may be used to mate covers 25, 27, within recesses 90*a*, 90*b*.

In an additional embodiment, one or more of the modular floor mats 10 may be provided with one or more sloped side edges (not shown) to permit wheeled vehicles, such as construction vehicles, to gain access to the modular flooring system. The sloped edge may contain a cam lock 20/cam receptacle 85 system for secure attachment, as described above. In addition, the sloped edge may contain corresponding flange surfaces 45*a*, 45*b* or flange surfaces 50*a*, 50*b*, and/or radiused edges, ensuring a conforming fit of the sloped side edge with the adjacent mat 10, as described previously.

In one embodiment, mats 10 may be stacked vertically in two or more layers to form a reinforced construction surface or roadway. Such stacking is useful in creating an ultra-strong access pad over very soft ground. Such a double stacking procedure may also be useful for deep mud applications or for areas where greater clearance from a soft ground surface is required. In this embodiment, the seam lines between adjacent tiles are staggered between the top and bottom layer to provide additional strength and moisture protection.

In an additional embodiment, inventory control chips (ICs) (not shown) may be embedded into mat 10 for transmission or reception of an electronic signal. The chip may be fitted into mat 10 by placement under the outermost lower flange top cover 27. The space created by the ribbed lattice structure 40*a*, 40*b* allows for the use of a variety of ICs as is known in the art.

Finally, one preferred embodiment of the invention has been described hereinabove and those of ordinary skill in the art will recognize that this embodiment may be modified and altered without departing from the central spirit and scope of the invention. Thus, the embodiment described hereinabove is to be considered in all respects as illustrative and not restrictive. The scope of the invention being indicated by the appended claims rather than the foregoing descriptions and all changes which come within the meaning and range of equivalency of the claims are intended to be embraced herein.

What is claimed is:

1. A modular mat for forming a floor covering, comprising:

a substantially flat main body having an internal lattice integrally formed within a central core area thereof;

a least one offset mating flange extending outwardly from said main body and constructed integrally therewith; and at least one offset cam lock mounted within at least one of said main body and said mating flange and at least one complimentary offset cam receiver mounted within the other of said main body and said mating flange, each at least one offset cam lock engaging each at least one complimentary offset cam receiver and, upon actuation of said at least one offset cam lock, drawing and locking said main body to said mating flange;

wherein said at least one offset cam lock and complimentary receiver are mounted such that a first modular mat mates and compressively interlocks with a second like modular mat to form a substantially flat, single layer combination surface.

2. A modular mat of claim 1, further comprising a removable cover, selectively affixed to said mat, which encloses said central core area and said internal lattice.

3. A modular mat of claim 1, wherein said offset mating flange further comprises a internal lattice formed within a core area thereof.

4. The modular mat of claim 1, further comprising at least one removable cover, selectively affixed to said mat, which encloses at least one of: (i) said central core area of said main body and (ii) said core area of said offset flange.

5. The modular mat of claim 4, wherein said at least one cover further comprises a protrusion interface with at least one of said main body and said offset flange which maintains said at least one removable cover in a restrained position with respect to said modular mat.

6. The modular mat of claim 5, wherein said protrusion interface further comprises a cavity containing a seal, and wherein said cavity receives and restrains said protrusion of said at least one removable cover.

7. The modular mat of claim 4, wherein at least one of said main body and said offset flange further comprise at least one recess in a top surface, said at least one recess and said at least one cover sized and shaped for close engagement, said at least one recess receiving said at least one cover.

8. The modular mat of claim 1, said at least one offset mating flange further comprising at least one inward radiused edge and at least one outward radiused edge, wherein said offset mating flange is mounted such that the at least one inward radiused edge of a mating flange of a first mat mates and interlocks with at least one outward radiused edge of a mating flange of a second mat in a direction that deviates substantially from the vertical direction.

9. The modular mat of claim 4, wherein said main body removable cover further comprises a plurality of fraction elements.

10. The modular mat of claim 1 wherein said at least one offset cam lock is actuated by rotation.

11. The modular mat of claim 1, further comprising one or more sloped side edges.

12. The modular mat of claim 1 further comprising an electronic inventory control chip for electronic location detection of said modular mat.

13. A modular floor covering system comprising a plurality of interconnected mats wherein each of said component mats comprises:

a substantially flat main body having an internal lattice integrally formed within a central core area thereof;

a least one offset mating flange extending outwardly from said main body and constructed integrally therewith; and at least one offset cam lock mounted within at least one of said main body and said mating flange and at least one complementary offset cam receiver mounted within the other of said main body and said mating flange, each at least one offset cam lock engaging each at least one complimentary offset cam receiver and, upon actuation of said offset cam lock, drawing and locking said main body to said mating flange;

wherein said at least one offset cam lock and complimentary receiver are mounted such that a first modular mat mates and compressively interlocks with a second like modular mat to form a substantially flat, single layer combination surface.

14. A modular floor covering system of claim 13, further comprising a removable cover, selectively affixed to said mat, which encloses said central core area and said internal lattice and said plurality of interconnecting mats and said removable covers forming a substantially continuous, single layer flat surface.

15. The modular floor covering system of claim 13, wherein said plurality of interconnected mats further comprises a plurality of fraction elements.

16. The modular floor covering system of claim 13 wherein said plurality of interconnected mats are compressively interlocked by engagement of said at least one offset cam lock and at least one complimentary receiver, respectively mounted on adjacent ones of said plurality of interconnected mats.

17. The modular floor covering system of claim 16 wherein said at least one offset cam lock is actuated by rotation.

18. The modular floor covering system of claim 13 wherein said mats further comprise one or more sloped side edges.

19. The modular floor covering system of claim 13, further comprising at least one sloped edge component which terminates at least a portion of one edge of said substantially flat, single layer combination surface, forming a transition between said surface and the ground.

20. The modular floor covering system of claim 13 wherein each of said plurality of interconnected mats further comprises an electronic inventory control chip for electronic location detection of said mat.

* * * * *